US005113547A

United States Patent [19]

Mayhew

[11] Patent Number: 5,113,547

[45] Date of Patent: May 19, 1992

[54] ADJUSTABLE WAND FOR CARPET SOIL EXTRACTORS

[76] Inventor: William H. Mayhew, 2229 Larchdale Dr., Cuyahoga Falls, Ohio 44221

[21] Appl. No.: 692,592

[22] Filed: Apr. 29, 1991

[51] Int. Cl.[5] ..... A47L 7/00

[52] U.S. Cl. ..... 15/322; 15/144 B; 15/354; 15/410

[58] Field of Search ..... 15/321, 322, 410, 354, 15/144 B

[56] References Cited

U.S. PATENT DOCUMENTS 2,074,042 3/1937 Bank ..... 285/7
2,938,225 5/1960 Carabet ..... 15/356
3,351,359 11/1967 Ferraris ..... 285/7
3,992,747 11/1976 Hufton ..... 15/322 X
4,234,995 11/1980 Parise ..... 15/322
4,433,451 2/1984 Parisi ..... 15/322 X

*Primary Examiner*—Chris K. Moore

[57] ABSTRACT

A wand for a carpet soil extractor includes a tubular member telescopically received within a sleeve. The sleeve has a bent handle. The sleeve and tubular member are rotatably adjustable about a common axis such that the handle of the sleeve may be made to lie in a common plane with the sleeve and tube. A nozzle assembly at the end of the tube is pivotally and adjustably mounted so that the angle of the nozzle with respect to the tube may be adjusted and secured.

16 Claims, 1 Drawing Sheet

ADJUSTABLE WAND FOR CARPET SOIL EXTRACTORS

TECHNICAL FIELD

The invention herein resides in the art of cleaning devices and, more particularly, to carpet soil extractors of the type typically used for wet-cleaning carpet. Specifically, the invention relates to a wand for such carpet soil extractors in which the wand is longitudinally extendable and collapsible, and wherein the vacuum nozzle is pivotally attached to the end of the wand. The invention accommodates the use of such wands beneath furniture and in tight quarters.

BACKGROUND ART

Heretofore various types of devices have been employed for the cleaning of carpet. One common type device is known as a carpet soil extractor or jet water extractor. In such devices, sources of cleaning solution and vacuum are provided in communication with a wand having a vacuum nozzle and spray nozzle at a working end thereof. By means of a valve, an operator can spray out cleaning solution immediately ahead of the vacuum nozzle as the wand is employed in its normal operating movement.

Typically, the wands employed with previously known carpet soil extractors have comprised a unitary tubular member with the vacuum nozzle fixedly and immovably attached to the working end. Such inflexible wands have not been conducive to utilization in tight quarters, nor have they allowed the spray and vacuum nozzles to be placed under low lying furniture such as beds and the like. Accordingly, tight corners have required difficult maneuvers by the operator while the cleaning under beds and the like has required actual movement and replacement of the bed.

Due to the inflexibility of previously known wands, there is a need in the art for an adjustable wand for such carpet soil extractors in which the length of the wand can be adjusted and the head of the wand can be set at various selected angles with respect to the wand axis. Prior art U.S. Pat. No. 3,962,745 teaches the basic concept of a wand and cleaning head for a carpet soil extractor in which the cleaning head is connected to the wand by a swivel. Cleaning heads for similar devices are shown in U.S. Pat. Nos. 4,083,077 and 4,559,667. Further, the basic concept of a telescopic wand is shown in U.S. Pat. Nos. 2,885,223, 3,351,359, 3,793,646, and 3,083,041. However, none of these prior art patents teach a telescoping wand satisfactory for implementation with a carpet soil extractor. Finally, U.S. Pat. Nos. 4,747,621 and 4,625,998 are of general interest to the concept of the invention in that they relate to swivel couplings for a hose interconnection. In like manner, U.S. Pat. Nos. 4,962,559, 3,949,442, and 4,494,270 are of general interest in that they teach various types of head and wand interconnections. However, they fall far short of teaching a concept readily adapted to a wand for a carpet soil extractor of the type presented herein.

DISCLOSURE OF INVENTION

In light of the foregoing, it is a first aspect of the invention to provide a wand for carpet soil extractors in which the length of the wand is adjustable.

Another aspect of the invention is the provision of a wand for carpet soil extractors in which the handle of the wand and the vacuum nozzle may be rotatably oriented with respect to each other.

An additional aspect of the invention is the provision of a wand for carpet soil extractors in which the vacuum nozzle of the wand may be adjustably angled and locked with respect to the wand itself.

Yet another aspect of the invention is the provision of a wand for carpet soil extractors in which the wand can comprise a pair of tubular members, telescopically receiving each other, and in which such members are rotatably positionally adjustable with respect to each other about a common axis.

An additional aspect of the invention is the provision of an adjustable wand for carpet soil extractors which is easy to construct, durable and reliable in use, and easily implemented with presently existing carpet soil extractors.

The foregoing and other aspects of the invention which will become apparent as the detailed description proceeds are achieved by a wand for a carpet soil extractor, comprising: a sleeve; a tube telescopically and rotatably received within said sleeve; a vacuum nozzle; first connection means interposed between said sleeve and said tube for locking interengagement of said sleeve and said tube at selected extension and relative rotational positions of said sleeve and tube with respect to each other; and second connection means interposed between said tube and said vacuum nozzle for locking interengagement of said nozzle with said tube at selected angles therebetween.

Additional aspects of the invention which will become apparent herein are attained by a wand for a carpet soil extractor, comprising: a sleeve; a tube telescopically received by said sleeve at a first end of said tube, said tube and sleeve having a common horizontal axis; said tube being selectively rotatable about said axis; and a vacuum head connected to a second end of said tube in selectively angled relation to said tube.

DESCRIPTION OF DRAWING

For a complete understanding of the objects, techniques and structure of the invention reference should be made to the following detailed description and accompanying drawing wherein.

BEST MODE FOR CARRYING OUT THE INVENTION

Figure 1:
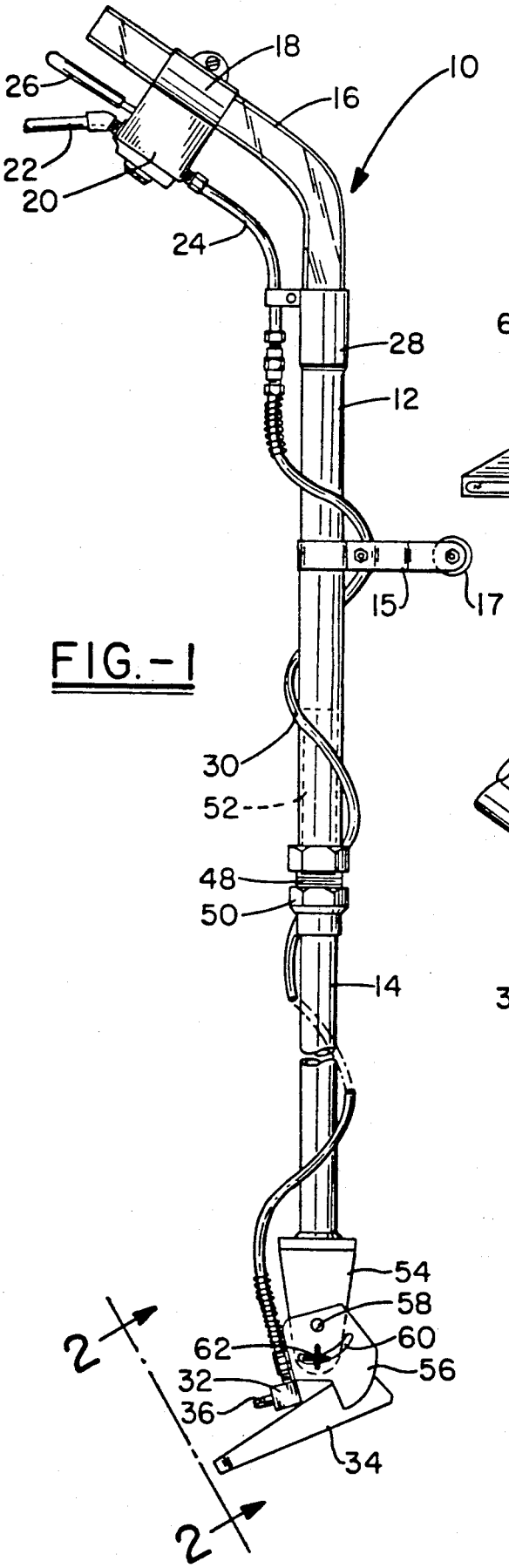
FIG. 1 is a side elevational view of a wand made according to the invention.

Referring now to the drawing and more particularly FIG. 1, it can be seen that a wand for a carpet soil extractor made according to the invention is designated generally by the numeral 10. It will be appreciated that the wand 10 would typically be interconnected to a pressurized source of cleaning solution and a vacuum source for purposes of spraying a cleaning solution upon the carpet and subsequently extracting the same. The wand 10 includes a sleeve 12 telescopically receiving a tube 14 therein. The sleeve 12 and tube 14 comprise a tubular conduit for interconnection with the vacuum source of a carpet soil extractor as through a hose or the like.

As shown, the sleeve 12 is bent at an end thereof to form a handle 16 for receiving one hand of the operator. The other hand of the operator is adapted to receive a handle 17 connected to a bracket 15 which is rigidly secured to the tubular sleeve 12.

A bracket 18 is secured to the handle portion 16 and is provided for purposes of securing and maintaining a valve 20 interposed between an inlet hose 22 and an outlet tube 24. The inlet hose 22 communicates with a pressurized source of cleaning solution as previously mentioned. A valve handle 26, positioned beneath the handle portion 16, extends from the valve 20 and is adapted to open and close the valve 20 to allow passage of pressurized cleaning solution from the source, through the hose 22, and into the outlet tube 24.

A bracket 28 is secured to the sleeve 12 and receives an end of the outlet tube 24 close to a point of interconnection with a flexible hose 30 which is coiled or otherwise wrapped about the sleeve 12 and tube 14 to its interconnection with the spray head 32 of the wand assembly 10. The spray head 32 comprises a plurality of spray nozzles 36 which, upon actuation of the valve 20, are operative to spray cleaning solution carried by the hose 30 therefrom.

Also provided as an integral part of the wand assembly 10 is a vacuum or suction nozzle 34 which performs the extraction function of the carpet soil extractor. The vacuum nozzle 34 communicates through the tube 14, sleeve 12, and interconnected hose with a vacuum source including an appropriate fan and receiving tank. In a preferred embodiment of the invention, the spray head 32 is connected to the vacuum nozzle 34, ether directly or by means of appropriate brackets or the like. As will further be appreciated by those skilled in the art, the vacuum nozzle 34 is provided with an appropriate slot or opening traversing the width thereof. The physical size and configuration of the opening 38 defines, to a great degree, the velocity of air drawn thereinto in response to the vacuum created at the vacuum source.

Figure 3:
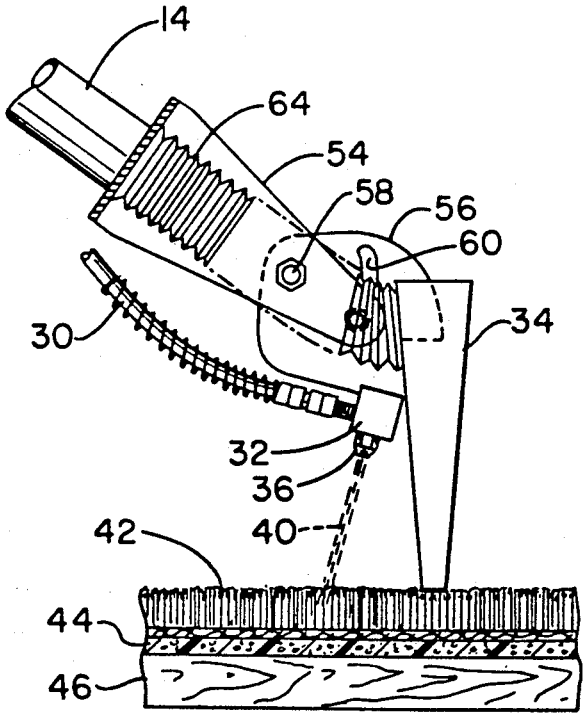
FIG. 3 is a partial sectional side elevational side of the end of the wand of the invention adjustably receiving the spray and vacuum nozzles.

With reference to FIG. 3, the standard operating procedure of the wand of a carpet soil extractor can be seen. As shown, upon actuation of the valve 20 by the valve handle 26, a cleaning solution 40 is sprayed from the spray nozzles 36 of the spray head 32 onto the carpet 42 extending over padding 44 and flooring 46. The wand 10 is moved from right to left as shown in FIG. 3 such that the cleaning solution 40 sprayed into the carpet 42 is then extracted by means of the vacuum or suction nozzle 34. With the cleaning solution 40 dissolving or entraining dirt within the carpet 42, dirt and residue entrained by the solution 40 is extracted from the carpet 42 to the tank associated with the vacuum source.

The ability of the wand 10 to telescope inwardly and outwardly, or to expand and contract, is an important feature of the instant invention. To this end, it will be noted that a threaded nipple 48 is appropriately connected to the sleeve 12. A locking slip nut 50 is received upon the tube 14 and is adapted to threadedly engage the threads of the nipple 48. As the slip nut 50 is threaded upon the nipple 48, an appropriate compression ring or the like lockingly engages between the tube 14 and nipple 48, locking the tube 14 and sleeve 12 in fixed seal relationship to each other. When loosened, the tube 14 may be move longitudinally with respect to the sleeve 12, or may be rotated about a common axis with respect thereto. Accordingly, the portion of the tube 14 telescopically received within the sleeve 12, and as designated by the numeral 52, can be altered to change the overall length of the wand 10. In like manner, the tube 14 may be rotated about the common axis which it shares with the sleeve 12 so that the orientation of the vacuum nozzle 34 and spray nozzle 32 with respect to the handles 16 and 17 can be selected. Once the length and orientation of the vacuum nozzle 34 has been set, they may be locked by means of the threaded engagement of the locking slip nut 50 with the nipple 48. Accordingly, the length of the wand 10 and orientation of the nozzle 34 with respect thereto can be adjusted.

Figure 2:
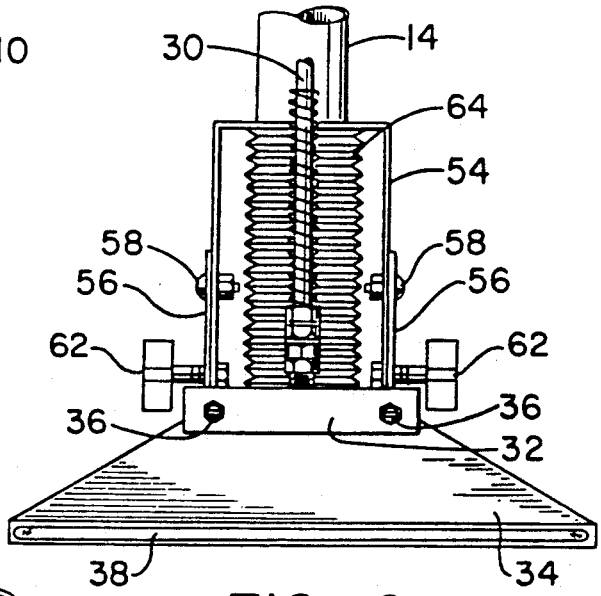
FIG. 2 is a perspective view of the spray and vacuum nozzles of the wand of the invention, shown in interconnection at the end of a telescopic tube of the wand.

As another important feature of the invention, the angle that the vacuum nozzle 34 makes with the tube 14 can be changed. To this end, a coupler housing 54 is fixedly connected to the tube 14. A pair of brackets 56, one on each side of the nozzle 34, are pivoted connected by means of pivot pins 58 to respective sides of the housing 54. Arcuate slots 60 are provided in each of the brackets 56, with the arcuate slots 60 receiving the bolts of locking nut and bolt assemblies 62. The nut portion of the assemblies 62 are fixed to the housing 54 as best shown in FIG. 2. It should now be appreciated that the angle that the vacuum nozzle 34 makes with respect to the tube 14 may be adjusted and locked by means of the arcuate slots 60 and locking nut and bolt assemblies 62. With the assemblies 62 loosened, the nozzle 34 and attached brackets 56 may be pivoted about the pins 58, with the bolts of the locking nut and bolt assemblies 62 riding within the slots 60. When the desired angle is achieved, the locking nut and bolt assemblies 62 are tightened to prevent further movement. Accordingly, the angled position of the vacuum nozzle 34 with respect to the tube 14 may be adjusted. To accommodate such adjustment, it will be observed that a flexible hose 64 interconnects the tube 14 with the vacuum nozzle 34.

In the preferred embodiment of the invention, the arcuate slots 60 are of such length as to allow the nozzle 34 to pass through an arc of 30°-60°, such arc encompassing a perpendicular extension of the vacuum nozzle 34 from the tube 14. It will be appreciated that the adjustability of the vacuum nozzle 34 at the end of the tube 14 allows the nozzle 34 to become significantly aligned with the tube 14 so that the nozzle and tube 14 may be extended under beds, furniture, and the like. It will also be noted that the handle 16 may be rotated to be substantially coplanar with the sleeve 12 and tube 14 to accommodate such extension under beds and furniture as described.

It should now be apparent that the instant invention has presented an adjustable wand for carpet soil extractors which is adjustable in length, has vacuum and spray nozzles which are adjustably angled at the end thereof, and in which the tubular handle may be oriented to be substantially coplanar with the tubular extension of the wand, minimizing the height, length and accessibility restrictions normally associated with such wands.

Thus it can be seen the objects of the objects of the invention have been satisfied by the structure presented above. While in accordance with the patent statutes only the best mode and preferred embodiment of the invention has been presented and described in detail, it is to be understood that the invention is not limited thereto to thereby. Accordingly, for an appreciation of the true scope and breadth of the invention reference should be made to the following claims.

What is claimed is:

1. A wand for a carpet soil extractor, comprising:

a sleeve;

a tube telescopically and rotationally received within said sleeve;

a vacuum nozzle;

first connecting means interposed between said sleeve and said tube for locking interengagement of said sleeve and said tube at selected extensions and relative rotational positions of said sleeve and tube with respect to each other; and second connection means interposed between said tube and said vacuum nozzle for locking interengagement of said nozzle with said tube at selected angles therebetween.

2. The wand according to claim 1, wherein said first connection means comprises a slip nut received upon said tube adapted for locking engagement with a threaded nipple connected to said sleeve.

3. The wand according to claim 2, wherein said second connection means comprises a housing connected to said tube and a bracket connected to said vacuum nozzle, said housing and bracket being pivotally connected to each other.

4. The wand according to claim 3, wherein said bracket has an arcuate slot receiving a locking bolt connected to said housing.

5. The wand according to claim 4, wherein said second connection means further comprises a flexible connector between said tube and said nozzle.

6. The wand according to claim 5, wherein said arcuate a slot accommodates angling of said vacuum nozzle with respect to said tube.

7. A wand for a carpet soil extractor, comprising:

a sleeve;

a tube telescopically received by said sleeve at a first end of said tube, said tube and sleeve having a common longitudinal axis, said tube being selectably rotatable about said axis;

a vacuum nozzle connected to a second end of said tube in selectably angled relation to said tube;

first locking means interposed between said sleeve and tube for locking said tube within said sleeve at a selected extension and rotational position of said tube within said sleeve, said first locking means comprising a sip nut joint between said sleeve and tube; and second locking means interconnecting said tube to said vacuum nozzle for locking said head at a selected angle with respect to said tube.

8. The wand according to claim 7, wherein said second locking means comprises a first bracket connected to said tube and a second bracket connected to said vacuum nozzle, said first and second brackets being pivotally interconnected.

9. The wand according to claim 8, wherein said second bracket has a slot therein and said first bracket receives a locking bolt passing through said slot, said locking bolt making locking engagement with said slot for locking said first and second brackets in fixed relation to each other.

10. The wand according to claim 9 wherein said second locking means further comprises a flexible hose interconnecting said tube and vacuum nozzle.

11. The wand according to claim 10, further comprising a spray nozzle in juxtaposition to said vacuum nozzle and a hose extending from said spray nozzle to a valve connected to said sleeve.

12. A wand for a carpet soil extractor, comprising:

a sleeve;

a tube telescopically received by said sleeve at a first end of said tube, said tube and sleeve having a common longitudinal axis, said tube being selectably rotatable about said axis;

a vacuum nozzle connected to a second end of said tube in selectably angled relation to said tube;

first locking means interposed between said sleeve and tube for locking said tube within said sleeve at a selected extension and rotational position of said tube within said sleeve; and second locking means interconnecting said tube to said vacuum nozzle for locking said nozzle at a selected angle with respect to said tube, said second locking means comprising a flexible hose interconnecting said tube and vacuum nozzle.

13. The wand according to claim 12, wherein said first locking means comprises a slip nut joint between said sleeve and tube.

14. The wand according to claim 12, wherein said second locking means comprises a first bracket connected to said tube and a second bracket connected to said vacuum nozzle, said first and second brackets being pivotally interconnected.

15. The wand according to claim 14, wherein said second bracket has a slot therein and said first bracket receives a locking bolt passing through said slot, said locking bolt making locking engagement with said slot for locking said first and second brackets in fixed relation to each other.

16. The wand according to claim 15, further comprising a spray nozzle in juxtaposition to said vacuum nozzle and a hose extending from said spray nozzle to a valve connected to said sleeve.

* * * * *